US006828075B2

(12) United States Patent
Suzuki et al.

(10) Patent No.: US 6,828,075 B2
(45) Date of Patent: Dec. 7, 2004

(54) CARRIER FOR ELECTROPHOTOGRAPHY AND DEVELOPER USING THE SAME

(75) Inventors: Kousuke Suzuki, Numadu (JP); Satoshi Mochizuki, Numadu (JP); Yasuo Asahina, Numadu (JP); Kazuhiko Umemura, Shizuoka (JP); Hideki Sugiura, Fuji (JP); Minoru Masuda, Numadu (JP); Tomomi Tamura, Numadu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/153,627

(22) Filed: May 24, 2002

(65) Prior Publication Data

US 2003/0186154 A1 Oct. 2, 2003

(30) Foreign Application Priority Data

May 24, 2001 (JP) ..... P2001-156091
Sep. 21, 2001 (JP) ..... P2001-290267
May 22, 2002 (JP) ..... P2002-147082

(51) Int. Cl.[7] ..... G03G 9/00
(52) U.S. Cl. ..... 430/111.1; 430/111.32; 430/111.35
(58) Field of Search ..... 430/111.1, 111.32, 430/111.35

(56) References Cited

U.S. PATENT DOCUMENTS

| | | | | |
|---|---|---|---|---|
| 4,762,763 | A | | 8/1988 | Nomura et al. |
| 4,933,250 | A | | 6/1990 | Nakayama et al. |
| 4,950,573 | A | | 8/1990 | Yamaguchi et al. |
| 4,980,258 | A | | 12/1990 | Aoki et al. |
| 5,061,588 | A | | 10/1991 | Fushimi et al. |
| 5,344,732 | A | | 9/1994 | Chiba et al. |
| 5,403,690 | A | | 4/1995 | Kuramoto et al. |
| 5,554,478 | A | | 9/1996 | Kuramoto et al. |
| 5,652,079 | A | * | 7/1997 | Mochizuki et al. ..... 430/111.1 |
| 5,670,287 | A | * | 9/1997 | Kawata et al. ..... 430/111.32 |
| 5,721,083 | A | | 2/1998 | Masuda et al. |
| 5,840,456 | A | | 11/1998 | Tomita et al. |
| 6,042,981 | A | | 3/2000 | Barbetta et al. |
| 6,074,794 | A | | 6/2000 | Fushimi et al. |
| 6,074,795 | A | | 6/2000 | Watanabe et al. |
| 6,180,298 | B1 | | 1/2001 | Kuroda et al. |
| 6,210,850 | B1 | * | 4/2001 | Ogata et al. ..... 430/111.1 |
| 6,303,258 | B1 | | 10/2001 | Katoh et al. |
| 2001/0019805 | A1 | * | 9/2001 | Ohba et al. ..... 430/110.4 |

FOREIGN PATENT DOCUMENTS

| | | |
|---|---|---|
| EP | 0 932 083 | 7/1999 |

* cited by examiner

*Primary Examiner*—Mark A. Chapman
(74) *Attorney, Agent, or Firm*—Oblon, Spivak, McClelland, Maier & Neustadt, P.C.

(57) ABSTRACT

A carrier for electrophotographic developer comprising carrier particles, each carrier particle having at least one surface-coating layer by resin material, wherein the surface-coating layer containing an acrylic resin and a silicone resin, the acrylic resin is in an amount ranging 10 to 90 wt. % based on the total amount of resin coating ingredients. The carrier shows no accumulation of toner-spents, therefore can obtain a stable electric charge, and has no layer scraping in binder resin layer, therefore can obtain a stable electric resistance, hence occurs no deterioration of images reproduced, by using acrylic resin having high anti-abrasive and high surface energy, whereas it has strong adhesiveness and high fragility, in combination use of silicone resin having poor anti-abrasive and small adhesiveness but has low fragility, thus is hard to cause a toner spent and hard to integrate the spent constituents due to its low surface energy.

19 Claims, No Drawings

CARRIER FOR ELECTROPHOTOGRAPHY AND DEVELOPER USING THE SAME

BACKGROUND OF THE INVENTION

1. Field of the Invention

The present invention relates to a carrier used in development of electrically charged latent image in electrophotography, electrostatic recording and electrostatic printing, a developer using the carrier, an image forming apparatus and method using the same.

2. Description of the Related Art

In image forming processes such as electrophotographic process and electrostatic recording in general a developer being obtained by mixing toner and carrier and agitating them is used for developing an electrostatic latent image formed on a latent image-bearing member. The developer is required to be a mixture being properly tribo-charged. There are known two developing methods for developing the electrostatic latent image; a two-component developing method using two-component developer comprising a mixture of a carrier and a toner, and a so-called one-component developing method using one-component developer which does not contain carrier component.

Two-component developing method has an advantage that it can produce comparably stable and excellent images, while it has a shortcoming that it apt to alter the ratio of toner amount and carrier amount being contained therein during processing. On the other hand the later of one-component developing method does not show the above mentioned shortcoming of former method, however has an inconvenience that it is hard to be stabilized in its tribo-electric charge property.

In the course of repeatedly conducted developments of latent images using the two-component developer, toner consisting of toner particles in the developer is gradually consumed and toner concentration in the developer is thus varied, therefore small quantities of toner are periodically added to the developer to compensate for toner consumed during repeated developments if necessary for the purpose of obtaining stable images. With regard to the method for controlling the toner supply, copy machines are in general equipped with sensor such as transparency-detecting sensor, fluidity-detecting sensor, bulk density-detecting sensor or other type of sensors, however sensors for measuring optical densities in images are prevailingly being used at the moment. Controlling method using this densitometric type of sensor is a method in which each optical density of image patterns having been developed on latent image-bearing members are measured using reflected light from irradiation onto the surfaces of the image-bearing members, thereby toner supplies are controlled.

In such two-component developer there are many known techniques in which a hard and high strength coating layer is provided onto each granular carrier particle by using proximate resin materials, with the purposes to prevent toner-filming on the carrier particle, to form the homogenous surface on the carrier particle, to prevent oxidizing of the carrier surface, to prevent decreasing humid tolerability of the carrier, to prolong the life of developer, to prevent carrier deposition onto the photosensitive member surface, to protect from scratching or abrasion of photosensitive member surface, and to control polarity or volume of electric charge in developer. For examples a carrier coated by particular resinous material (as shown in Japanese Unexamined Patent publication of Tokkai Shou No. 58-108548), carriers coated by the resinous layers containing various additives incorporated therein (as shown in Japanese Unexamined Patent publication of Tokkai Shou No. 54-155048, Japanese Unexamined Patent publication of Tokkai Shou No. 57-40267, Japanese Unexamined Patent publication of Tokkai Shou No. 58-108549, Japanese Unexamined Patent publication of Tokkai Shou No. 59-166968, Japanese Unexamined Patent publication of Tokkai Hei No. 1-19584, Japanese Examined Patent publication of Tokkou Hei No. 3-628, Japanese Unexamined Patent publication of Tokkai Hei No. 6-202381), a carrier having an additive provided thereon by adhering (as shown in Japanese Unexamined Patent publication of Tokkai Hei No. 5-273789), and a carrier coated by resinous layer which includes therein an additive of electrically conductive particles, each particle having larger diameter than thickness of the layer (as shown in Japanese Unexamined Patent publication of Tokkai Hei No. 9-160304) are instanced.

Further, Japanese Unexamined Patent publication of Tokkai Hei No. 8-6307 discloses a technique in which benzoguanamine-n-buthyl alkohol-folmaldehyde copolymer as a main ingredient is used as a carrier coating material, and Japanese Patent No. 2683624 discloses a technique in which a cross-linked material consisting of melamine resin and acrylic resin is used as a coating material.

However the durability and suppression of carrier deposition are still insufficient. Accordingly regarding to the durability, there are problems which include occurrence of toner spent onto carrier surface thereby tribo-electric charge volume becomes unstable, and decrease of coating layer thickness caused by scraping of coated material and thereby decreasing electric resistance. And if good quality images can be demonstrated at initial period of use, but it is encountered that image qualities are gradually declined in relation to the increase of copy numbers, which is a problem must be improved.

The change of carrier amount scooped up by developing roller is caused with scraping the coated layer of carrier coating. Particularly in case of conventional carrier having a coating layer consisting of resin having low surface energy, the coating layer has a high fragility and hence is apt to easily scrape off. As a result, diameter and surface characteristics of the carrier are changed, thus fluidity and bulk density are changed, as a result there is shown a problem that carrier amount scooped up by developing roller is changed with the progress of copying run.

SUMMARY OF THE INVENTION

The present invention has been made in contemplation of above mentioned problems, thus it is an object of the present invention to provide a two-component developer which is free from toner-spent onto the carrier surface, and is eliminated or decreased in the scrape of coated resinous layer on the carrier, thus is capable of providing fine and excellent quality of images with high precision for long period of running time.

Another object of the present invention is to provide a developer showing a few change of carrier amount scooped up onto developing roller for long period of running time.

Above and other objects are attained by the present invention including;

(1) A carrier for electrophotographic developer comprising carrier particles, each carrier particle having at least one surface-coating layer by resin material, wherein the surface-coating layer containing an acrylic resin and a silicone resin, the acrylic resin is in an amount ranging 10 to 90 wt. % based on the total amount of resin coating ingredients;

(2) A carrier for electrophotographic developer according to above paragraph (1), wherein the acrylic resin is a acrylic resin of thermo-harding type;

(3) A carrier for electrophotographic developer according to above paragraph (1), wherein the silicone resin is a silicone resin having condensation reactive functional groups;

(4) A carrier for electrophotographic developer according to above paragraph (1), wherein the surface-coating layer containing particles which have a particle-diameter (D) in the range of 1<[D/h]<5, in the relation of the (D) to the layer thickness (h) of the surface-coating layer;

(5) A carrier for electrophotographic developer according to above paragraph (1), wherein the surface-coating layer containing particles which have a particle-diameter (D) in the range of 1<[D/h]<5, in the relation of the (D) to the layer thickness (h) of the surface-coating layer, the particles having been applied in an amount ranging 50 to 95 wt. % based on the total amount of coating composition ingredients;

(6) A carrier for electrophotographic developer according to above paragraph (1), wherein the carrier containing particles which have a particle-diameter (D) of the range 1<[D/h]<5, in the relation of the (D) to the layer thickness (h) of the surface-coating layer, the particles consisting of any one selected from aluminum oxide, titanium dioxide, zinc oxide and any modified one thereof which having been treated on its surface, or any whose combination;

(7) A carrier for electrophotographic developer according to above paragraph (1), wherein the surface-coating layer containing carbon black material.

(8) A carrier for electrophotographic developer according to above paragraph (1), wherein the acrylic resin containing carbon black material.

Further, above and other objects are also achieved by the present invention including;

(9) A carrier for electrophotographic developer comprising carrier particles, each carrier particle having at least a surface-coating layer consisting of a plural of resin material layers, wherein the surface-coating layer consisting of an acrylic resin layer and a silicone resin layer, the acrylic resin is in an amount being ranged 10 to 90 wt. % based on the total amount of resin coating ingredients;

(10) A carrier for electrophotographic developer according to above paragraph (9), wherein the acrylic resin layer is an inner layer being contacted with carrier particle surface, and the silicone resin layer is an outer layer being overlaid on inner layer.

(11). A carrier for electrophotographic developer according to above paragraph (9), wherein the silicone resin layer is a layer of silicone resin having condensation reactive functional groups;

(12) A carrier for electrophotographic developer according to above paragraph (9), wherein the acrylic resin layer is an acrylic resin layer of thermo-harding type.

(13) A carrier for electrophotographic developer according to above paragraph (9), wherein the carrier containing particles which have a particle-diameter (D) of the range 1<[D/h]<5, in the relation of the (D) to the layer thickness (h) of the surface-coating layer;

(14) A carrier for electrophotographic developer according to above paragraph (9), wherein the carrier containing particles which have a particle-diameter (D) of the range 1<[D/h]<5, in the relation of the (D) to the layer thickness (h) of the surface-coating layer, the particles having been applied in an amount ranging 50 to 95 wt. % based on the total amount of coating composition ingredients;

(15) A carrier for electrophotographic developer according to above paragraph (9), wherein the carrier containing particles which have a particle-diameter (D) of the range 1<[D/h]<5, in the relation of the (D) to the layer thickness (h) of the surface-coating layer, the particles consisting of any one selected from aluminum oxide, titanium dioxide, zinc oxide and any modified one thereof which having been treated on its surface, or any whose combination;

(16) A carrier for electrophotographic developer according to above paragraph (9), wherein the surface-coating layer containing carbon black material;

(17) A carrier for electrophotographic developer according to above paragraph (9), wherein the acrylic resin layer containing carbon black material.

Furthermore, above and other objects are still achieved by the present invention including;

(18) An electrophotographic developer comprising at least a toner containing toner particles and a carrier containing carrier particles, each toner particle containing a binder resin and a coloring agent, and each carrier particle having at least a surface-coating layer by resin material, wherein the surface-coating layer comprising an acrylic resin and a silicone resin, the acrylic resin is in an amount$_{13}$being ranged 10 to 90 wt. % based on the total amount of resin coating ingredients;

(19) An image forming apparatus using an electrophotographic developer, comprising at least a toner containing toner particles and a carrier containing carrier particles, each toner particle containing a binder resin and a coloring agent, and each carrier particle having at least a surface-coating layer by resin material, wherein the surface-coating layer comprising an acrylic resin and a silicone resin, the acrylic resin is in an amount being ranged 10 to 90 wt. % based on the total amount of resin coating ingredients;

(20) An image forming method using an electrophotographic developer, comprising at least a toner containing toner particles and a carrier containing carrier particles, each toner particle containing a binder resin and a coloring agent, and each carrier particle having at least a surface-coating layer by resin material, wherein the surface-coating layer comprising an acrylic resin and a silicone resin, the acrylic resin is in an amount being ranged 10 to 90 wt. % based on the total amount of resin coating ingredients.

Features of the present invention accompanied with above mentioned and other objects, and advantages of the present invention will be fully appreciated upon consideration of following detailed descriptions.

We, the inventors have studied for the purpose of solving above described problems belonged to conventional techniques, and as a result, it is found out that significant improvements are achieved by using at least an acrylic resin and a silicone resin to electrophotographic carrier having at least surface-coating layer of resinous material.

From above mentioned result, it is thought that the acrylic resin shows high anti-abrasive and high surface energy, whereas it has strong adhesiveness and high fragility, thus is apt to easily cause a toner-spent and is hard to be suffered from layer scraping, thereby there is an occurred problem that integration of spent constituents is apt to be made progress, on the other hand silicone resin shows poor anti-abrasive and small adhesiveness but has low fragility, thus is hard to cause a toner spent and hard to integrate the spent constituents due to its low surface energy. And the coating layer having excellent anti-abrasive with a high tolerance for toner spent is considered to be able to obtain by conducting a proper balance between individual characteristics brought from the both resins.

Further, it is clarified in the present invention that, in a carrier having carrier particles in which each carrier particle having a surface-coating layer by resin material, if the surface-coating layer is constituted by a plural of sub-layers to effect a improvement thereof, thens a significant improvement is realized.

From the result, it is thought that there are many required functions for the carrier coating layer, for examples such as anti-spent function, anti-abrasive function, adhesive function and other functions, and there are existing materials which having each own superior function, accordingly, excellent coating layer having good functions may be achieved by combined utilization, for functions-sharing, of two sort of materials which have each individual and excellent functions.

Hereinafter, each resin for the coating is described in detail. With regard to the acrylic resin, the acrylic resin in the present invention has no particular limitation, hence is available all resins having acrylic component therein, however it is favorable to employ thermoplastic acrylic resin. In general arylic resin is superior in anti-abrasive, because it has excellent adhesiveness and low fragility, therefore layer-scraping is hardly occurred when it is used for carrier coating, accordingly changes of scooping amount of developer scooped up onto developing roller are few through the period of running time. The changes of the scooping amount of developer include an increase and a decrease of scooping amounts, and the both changes may cause inconveniences. The increase of the scooping amount results an increase of developer amount contacted with surface of latent image-bearing member (such as photosensitive member), thereby contacting width of developing site is spread, thus, once developed toner image is destroyed by followed developers, on the contrary, the decrease of the scooping amount results an decrease of developer amount to be contacted with latent image, thereby a problem of difficulty to form toner image is brought. It is favorable in the present invention that the scooping amount of developer is in the range from 40 $mg/cm^2$ to 100 $mg/cm^2$ after 300,000 paper sheets run, against an initially adjusted scooping amount of 70 $mg/cm^2$, otherwise may induce a significant deterioration of image quality developed and thereby sometimes can not use it.

And it is possible to use the acrylic resin alone, while a simultaneous use of at least one other component capable of cross-linking reaction with the acrylic resin is also possible. In this case the other component capable of cross-linking reaction includes, but not restricted to, for examples, amino resin, acidic catalyst and other catalysts. The amino resin means but not restricted to, for examples, guanamine, melamine resin and the like. And as the acidic catalyst may employ all kinds of materials exhibiting catalystic action. Examples are instanced as materials having reactive groups such as, but not restricted to, perfect alkyl type of, methylol type of, imino type of, methlol-imino type of reactive groups.

Next, with regard to the silicone resin, for the kind of silicone resin in the present invention has no particular limitation, hence is usable all kinds of silicone resins which are known in general, including straight silicone consisted of sole organo-siloxane bonds, alkyd resin-modified silicone resins, polyester, epoxy resin, acrylic resin, polyurethane and so on, but the silicone resin is not restricted thereto. Examples of commercially available straight silicone resins are denoted as KR-271, KR-255, KR-152 made by Shin-Etsu Chemical Co.,Ltd., SR-2400, SR-2406, SR-2410 made by Toray Dow Corning Silicone Co.,Ltd and the like. In this case it is possible to use the silicone resin alone, while a simultaneous use of other components capable of cross-linking reaction with the silicone resin, charge controlling agent and other agent are also possible. Further, examples of modified silicones are denoted as KR-206 (alkyd-modified), KR-5208 (acrylic resin-modified), ES-1001N (epoxy-modified), KR-305 (urethane-modified) made by Shin-Etsu Chemical Co.,Ltd., SR-2115 (epoxy-modified), SR-2110 (alkyd-modified) made by Toray Dow Corning Silicone Co.,Ltd and the like.

Furthermore, in the coating layer consisting of the acrylic resin and the silicone resin of the present invention, a significant effect is conducted by use of the acrylic resin in an amount of 10 to 90 wt. % based on the total amount of resin coating ingredients.

The use amount less than 10 wt. % of acrylic resin is unfavorable, because most parts in all coating layer are occupied by silicone resin ingredient, therefore deterioration in anti-abrasive is caused by the silicone resin which has a deficiency of high fragility, while in case of use amount more than 90 wt. % of acrylic resin, most parts in all coating layer is occupied by it, therefore toner-spents are accumulated by the acrylic resin which has deficiencies of a high level of surface energy and a scarce layer-scraping nature.

Accordingly it is now clarified that a significant effect is conducted by the acrylic resin in an amount of 10 to 90 wt. % based on the total amount of resin coating ingredients, due to the identical reason as that above mentioned.

Further it is clarified that another significant effect is conducted by a resin coating layer containing an acrylic resin layer and a silicone resin layer wherein the inner layer is the acrylic resin layer which being contacted with the carrier particle, while outer layer is a silicone resin layer which being overlaid on the inner layer.

Acrylic resin layer constitutes the inner layer which being contacted with carrier particle, thereby the contacted layer becomes a strong adhesive and soften layer, which makes strong bonding with carrier core material and simultaneously makes itself possible to absorb and mitigate the impact power added onto the surface of silicone resin layer coating on carrier, during mixing of the developer including the carrier, thus it enables to inhibit or suppress the silicone layer-scraping.

On the other hand, as the silicone resin layer constitutes the outer layer, thereby carrier surface is substantially covered by the silicone resin, as a result, as described above, good effects are given which include high durability against toner-spent, which is resulted by low surface energy as a property of the silicone resin, and scarce accumulation of spent ingredients is resulted by layer-scraping thereof. And by generating respective effects of those two kinds of resin materials having mutually different natures in a balanced and high efficiency, synergy effect is obtained and thereby significant improvement is attained.

Furthermore, by making contained particles which have a particle-diameter (D) of the range $1<[D/h]<5$, in the relation of the (D) to the layer thickness (h) of the surface-coating layer, the effects of the present invention become more significant.

When the relationship between the particle-diameter (D) and the layer thickness (h) shown by $1<[D/h]<5$ is being held, the particles are projected upon the surface of coating layer, thereby contacts in accompany with strong shocks in the binder resin of each carrier particle, which would be caused to the binder resin by abrasion with toner and other carrier particles during mixing of the developer to yield tribo-charge thereto, may mitigate. By these phenomena, the toner spent to the carrier becomes possible to be prevented, and the layer-scrape of binder resin in which the tribo-electric charge is generated also becomes possible to be prevented. The value [D/h] less than 1 causes the situation of the sunk particles into the binder resin, thereby effects are seriously decreased thus unfavorable. The value [D/h] more than 5 can not give sufficient retaining power due to the resulted small contacting area of particles with binder resin thus also unfavorable.

Moreover, by supplying total amount of the particles to be added into the surface-coating layer ranging 50 to 95 wt. % in coating composition, favorably 70 to 90 wt. %, the effect in the present invention becomes more significant.

The particles amounted less than 50 wt. % make a carrier surface containing small amount of the particles in comparison with binder resin amount, therefore the contacts accompanying with strong shocks for the binder resin of each carrier particle are hardly mitigated, therefore enough durability is not given thus unfavorable. On the other hand, the particles amounted more than 95 wt. % may not give sufficient effect due to the excess contained particles comparing with binder resin amount in carrier surface, therefore binder resin which generates tribo-electricity becomes a shortage in amount contained, thus the carrier can not demonstrate enough chargeability. In addition that, as the contained particles comparing with binder resin amount are excess, thus can not give sufficient retaining power due to the resulted small contacting area of fine particles with binder resin thus unfavorable.

An invention disclosed in above mentioned Japanese Unexamined Patent publication of Tokkai Hei No. 9-160304, which has similar points to the present invention, is differed from the present invention particularly in the point of amount of particles contained, namely "0.01 to 50 wt. % of coating resin" in the Tokkai Hei No. 9-160304 is converted to "0.01 to 33.33 wt. % of coating film ingredients" of the present invention by calculating method of the present invention, in this amount the tolerance may be improved, however as described above, sufficient tolerance can not given because particles amount at carrier surface in comparison with binder resin amount are too few thereby mitigating effect against contacts in accompany with strong shocks for the binder resin of each carrier particle is small thus unfavorable.

The particles described here indicate all of fine particles denoted in general fine particles such as metallic particles, metallic oxide particles, resin particles and other kinds of particles, and there is no specific restriction in their forms and materials. With regard to their particle size, taking account of balance between carrier core material and diameter of the particles, it is favorable but not limited to be particle size less than 5 $\mu$m. And the particles which are treated on their surfaces may also be employable. Further, they can use each alone or in their combination. Resin for including the particles is not special limitation but is favorable to be included in a resin having strong adhesiveness. For example when acrylic resin which has strong adhesiveness and elasticity is employed for including the particles, the particles are made to a hardly adhered with the resin, hence can avoid or suppress the liberalization of the particles from the resin, and also can absorb the shock affected onto the carrier by the elasticity, thereby effects to inhibit pulverizing and scraping of the particles are caused, thus making capable of holding the particles on the carrier surface for long period of time.

Furthermore, the effects of the present invention become significant by use of any one of alumina, titane dioxide, zinc oxide, any surface treated one thereof, or any their combination.

As a reason to make including the particles, there is an obtained effect to protect coating layer from the external stress imposed to the carrier surface from outside, and if the particle is easily pulverized or abraded by the external stress, the protection effect for coating layer may be demonstrated with in initial use stage only, however the effect is can not lasted for long period of use time, stable qualities are not maintained thus unfavorable. The particles such as above denoted have a high strength nature hence are high tolerance for the external stress, and do not cause pulverizing abrasion, thus can maintain the protection effect for the coating layer for long period of time. The particle diameter in a size less than 5 $\mu$m is favorable.

Further, as described above, for holding the particles on the carrier surface for long period of time, it is effective to be included a resin having strong adhesiveness in the coating layer. The resin having strong adhesiveness here may include resin used for general adhesive, while may favorably include above described acrylic resin, whereas it shows very strong holding characteristic. However this is only one example and the present invention is not restricted thereto.

By incorporating carbon black material in the coating layer in the present invention, the effect becomes more significant.

This is based upon the fact that the carbon black is usable as electric resistance-controlling agent for decreasing the electric resistance of coating layer which consisting of merely coating resin or coating resin and the particles, in the case that coating layer shows high electric resistance. Generally speaking, in case of making copy image having widely spread solid image using a high resistance carrier as a component of developer, central part of the widely spread solid area image has low optical density, while high optical density is resulted at periphery part of it, hence resulting such kind of images well affected so-called edge effect. And in case of making copy having images of letters or fine lines, clear images are reproduced by the edge effect, while in case of half-tone images, they have deficiency that they are reproduced with very poor reproducivity. Accordingly it becomes possible that excellent images are obtained by using carbon black adequately. The carbon black may include those generally used for carrier or toner.

Further, more significant effect is conducted by the carbon black existed in the acrylic resin in the present invention. In case of carrier for color images, if tips of scraped layer are introduced and mixed into the any the image reproduced and the tips of scraped layer have high optical density, they are out-standing hence cause deficient image. As stated above, acrylic resin has strong adhesiveness and low fragility, therefore shows good anti-abrasive, hence is hard to occur layer-scraping, accordingly it does not produce deficient image even if it contains carbon black. On the other hand, in case of silicone resin, as stated above, it has weak adhesiveness and high fragility, therefore shows poor anti-abrasive, therefore it is apt to occur layer-scraping easy, accordingly it produces deficient image when it contains carbon black, thus it can not use for carrier for color images. This explanation is made as for carrier for color images, but it is obvious that carrier of the present invention also can use for black images or for mono-chrome images.

Further, more significant effect is also conducted by a developer consisting of a toner having binder resin and coloring agent, and a carrier of the present invention.

In this case, employable developers are altered depending on the matter that if the carbon black is existing in only acrylic resin, or not. If the carbon black is exiting in only acrylic resin, as explained above, acrylic resin has strong adhesiveness and low fragility, therefore hence is hard to occur layer-scraping, accordingly it does not produce deficient image even if it contains carbon black, hence it is used in both for color images and mono-chrome images. On the other hand, if the carbon black is existing in other resin than acrylic resin, especially is existing in silicone resin, then layer-scraping is occurred, therefore it can not use for other color developer than color black developer.

Binder resin of the toner includes known those as described below which can be employed alone or in combination.

As styrene type of binder resins include for examples homopolymer of stylene and its derivatives(such as poly-p-styrene, polyvinyltoluene), styrene copolymer (such as styrene-p-chlorostyrene copolymer, styrene-propylene copolymer, styrene-vinyltoluene copolymer, styrene-methyl acrylate copolymer, styrene-ethyl acrylate copolymer, styrene-butyl acrylate copolymer, styrene-methyl methacrylate copolymer, styrene-ethyl methacrylate copolymer, styrene-butyl methacrylate copolymer, styrene-metyl-α-chlormethacrylate copolymer, styrene-acrylonitrile copolymer, styrene-vinylmethylether copolymer, styrene-vinylmethylketone copolymer, styrene-butadiene copolymer, styrene-isoprene copolymer, styrene-maleic acid copolymer, styrene-maleic acid ester copolymer.

As acrylic resin includes for examples poly methyl methacrylate, poly butyl methacrylate.

And as others include for examples poly vinyl chloride, poly vinyl acetic acid, polyethylene, polypropylene, polyester, polyurethane, epoxy resin, polyvinyl butyral, poly acrylic acid resin, rosins, modified rosin, terpenic resin, phenollic resin, resin of aliphatic or cycloaliphatic hydrocarbon type, aromatic petroleum resin, chlorinated paraffin, paraffin wax.

And, as binder resins for fixing by pressure includes known those as described below which can employed alone or in combination.

Those are for examples, but not restricted to, polyoleffins (such as low-molecular polyethylene, low-molecular polypropylene), oleffin copolymer (such as ethylene-acrylic acid copolymer, ethylene-acylate copolymer, styrene-methacrylate copolymer, ethylene-methacrylate copolymer, ethylene-vinychloride copolymer, ethylene-vinylacetate copolymer, ionomer resin), epoxy resin, polyester resin, styrene-butadiene copolymer, polyvinylpyrrolidone, methylvinyl ether-maleic acid anhydride copolymer, maleic acid-modified phenol resin.

Suitable coloring agents and/or bigments used in the present invention include, but are not limited to, following materials. Examples of black coloring agent incule, but are not limited to, carbon black, aniline black, furnace black, lamp black, iron black and the like. Examples of cyan coloring agent include, but are not limited to, phthalocyanine blue, inethylene blue, Victoria Blue, Methyl Violet, aniline blue, Ultramarine Blue, and the like. Examples of magenta coloring agent include, but are not limited to, Rhodamine 6G lake, dimethyl quinacridone, Watching Red, Rose Bengal, Rhodamine 6B, alizarin lake and the like. Examples of yellow coloring agent include, but are not limited to, chrome yellow, benzidine yellow, Hansa yellow G, naphtol yellow, molybdenum orange, quinoline yellow, tartrazine and the like.

The toner composition used in the present invention may also includes as charge (or in other words, so-called tribo-electric charge) controlling agents, but not limited to, such as nigrosine type of dyes, quaternary ammonium compounds, polyer containing amino groups, metallic complexes of azo dyes, nitrohumic acid and salts thereof, metal complexes with salicylic acid, naphthoic acid or dicarboxylic acid, organic dye materials.

Such additional materials as charge (or in other words, so-called tribo-electric charge) controlling agents which are exemplified as metallic complexes of organic compound such as mono-azo dyes, amino compounds of Co, Cr, of Fe metal complexes with salicylic acid, naphtoic acid or dicarboxylic acid, and organic dye materials.

The toner used in the present invention may also includes fixing-supplementary agent other than above binder resin, coloring agent and charge controlling agent. By this fixing-supplementary agent, the toner can be used in a fixing system which does not require the application of oil for preventing toner-clinging, so-called oil-less system. As the fixing-supplementary agents include known agents, those are for examples, but not restricted to, polyoleffins(such as polyethylene, polypropylene), metal salts of fatty acids, esters of fatty acids, paraffin wax, waxes of amido type, waxes of polyalcohol types, silicone vanish and the like, but the agents are not limited thereto.

These charge controlling agent and fixing-supplementary agent are may added into the inside of each toner particle through its preparation action, or may added to the produced toner consisting of toner particles. Accordingly an electrophotographic developer in the present invention comprising at least a toner containing toner particles and a carrier containing carrier particles means a developer which does not exclude such auxiliary agents being added.

With regard to the core material, from the point of view of preventing carrier-frying to deposit to the electrostatic latent image-bearing member surface, it is favorable to employ core material of diameter ranging from 20 μm to 100 μm, from the point of view for preventing generation of carrier scratching trace or flaw thus preventing deterioration of image quality.

Tangible examples are that known to use for two component type of developer in electrophotography, and ferrite, magnetite, iron, nickel and the like are instanced, those are may selected pursuant to the usage and purpose.

Having generally described this invention, further understanding can be obtained by reference to following specific examples which are provided herein for the purpose of illustration only and are not intended to be limiting. In the descriptions in the following examples, the numbers represent weight ratios unless otherwise specified.

EXAMPLES

Example 1

| | |
|---|---|
| Acrylic resin solution (Acridic A-405 made by Dai Nippon Ink Chemical, solid 50 wt. %) | 21.0 parts |
| Guanamine solution (solid 70 wt. %) | 6.4 parts |
| Toluene | 105 parts |
| Butyl cellosolve | 105 parts |

Above ingredients were dispersed using a homomixer for 10 minutes, to obtain an acrylic resin solution. Then,

| | |
|---|---|
| Silicone type of resin solution (SR2410 made by Toray Dow-corning Ltd., solid 23 wt. %) | 63.9 parts |
| Amino silane (SH6020 made by Toray Dow-corning Ltd., solid 100 wt. %) | 0.3 parts |

were dispersed by agitator in a vessel for 5 minutes, and obtained silicone solution was added into the homomixer which including therein above prepared acrylic resin solution, then the mixture were further dispersed for 10 minutes to yield a coating layer-forming solution.

As core material, calcined ferrite powder(F-300 made by Powdertech Co. Ltd, average particle diameter 50 μm) was employed, the powder was coated by above described coating layer-forming solution so as to give 0.15 μm thickness of coated layer, with using SPIRA COTA(Registered trademark by OKADA SEIKO Co. Ltd.).

Obtained carrier was baked in an electric furnace at 150° C. for one hour. After allowed to cool, the ferrite powder bulk was pulverized using a metal sieve having 106 μm width openings to result a carrier.

As the picture by transmission electron microscope (TEM) reveals a visible state of cross sections of carrier particles, thickness of the coated resin layer was determined by observing cross sections of carrier particles using TEM, and calculating average thickness from obtained thickness data.

Carrier obtained by above described method was mixed with a toner to produce 380 g of a developer having 5 wt. % of toner concentration, then which was set upon a commercially available digital full color copy machine which was a remodeled one of Imagio Color 2800 (registered trademark by Ricoh Company Ltd.), an original image chart having 5% ratio of image area was employed, evaluations of the results from 300,000 paper sheets of run were made with image reproductions having single black color. With regard to the carrier after finishing the 300,000 sheets of run, a decrease amount in electric charge of the carrier, a decrease value in electric resistance of the carrier, a change degree in scooped up amount of the developer onto developing roller were examined, resultants are shown in Table 2.

The "decrease amount in electric charge of the carrier" in the present invention means a variance amount between electric charge amount (Q1) of carrier in developer sample at initial stage which being mixed and agitated 95 wt. % of the carrier and 5 wt. % of the toner to make it being tribo-electrically charged, and electric charge amount (Q2) of carrier obtained by blowing-off of toner particles remained in the developer after 300,000 paper sheets of run, the objective value of the decrease amount in electric charge of the carrier was of within 5.0 (μc/g). Both electric charge amounts (Q1)and (Q2) were measured by a blow-off method using TB-200 which is a triboelectricity-measuring instrument manufactured by Toshiba Chemical Corp. Ltd. The decrease in electric charge of the carrier is mainly caused by toner spent on the carrier surface, therefore the decrease in electric charge of the carrier can mitigate by suppressing the toner spent.

The "decrease value in electric resistance of carrier" in the present invention means a variance value between volumetric electric resistance converted from the measured electric resistance of carrier in developer sample at initial stage (R1) by use of high resist-meter and volumetric electric resistance of carrier obtained by blowing-off the toner particles constituting the toner remained in the developer after 300,000 paper sheets run (R2) by use of same high resist-meter, the objective value of the decrease value in electric resistance of carrier was of within 2.0 Log (Ω·cm). Both volumetric resistances (R1) and (R2) were measured by steps consisting of placing the each carrier sample in the space between parallel electrodes of the high resist-meter for measuring electric resistance, imposing electric voltage of DC 250V to the sample, and measuring electric resistance of the sample after time lapse of 30 seconds. The decrease in electric resistance of carrier is mainly caused by layer-scraping of coated resin, therefore the decrease in electric resistance of carrier can mitigate by suppressing the layer-scraping.

And "the change degree in scooped up amount of the developer onto developing roller" in the present invention is demonstrated by the scooped up amount of developer after 300,000 paper sheets of run, where the scooped up amount of developer at initial stage was set at an amount of 70 mg/cm$^2$.

Example 2

| | |
|---|---|
| Acrylic resin solution (Acridic 53-580 made by Dai Nippon Ink Chemical, solid 50 wt. %) | 21.0 parts |
| Guanamine solution (solid 70 wt. %) | 6.4 parts |
| Alminium oxide ($Al_2O_3$) particles (0.1 $\mu$m, $10^{14}$ $\Omega \cdot$ cm of specific resistance) | 24.5 parts |
| Toluene | 215 parts |
| Butyl cellosolve | 215 parts |
| The mixture was dispersed using a homomixer for 10 minutes to obtain an acrylic resin solution. Then, | |
| Silicone type of resin solution (SR2410 made by Toray Dow-corning Ltd., solid 23 wt. %) | 63.9 parts |
| Amino silane (SH6020 made by Toray Dow-corning Ltd., solid 100 wt. %) | 0.3 parts |

were dispersed by agitator in a vessel for 5 minutes, and obtained silicone solution was added into the homomixer which including therein above prepared acrylic resin solution, then the mixture were further dispersed for 10 minutes to yield a coating layer-forming solution.

As core material, same ferrite powder as that used in Example 1 was coated by above prepared coating layer-forming solution so as to give 0.15 $\mu$m thickness of coated layer, with using SPIRA COTA(Registered trademark by OKADA SEIKO Co. Ltd.).

Obtained carrier was baked in an electric furnace at 150° C. for one hour. After allowed to cool, the ferrite powder bulk was pulverized using a metal sieve having 106 $\mu$m width openings to result a carrier. Thus obtained carrier was provided to the similar evaluations as that of Example 1. Resulted decrease amount in electric charge, decrease value in electric resistance, change degree in scooped up amount of the developer onto developing roller are shown in Table 2.

Example 3

| | |
|---|---|
| Acrylic resin solution (Acridic A-322 made by Dai Nippon Ink Chemical, solid 50 wt. %) | 21.0 parts |
| Guanamine solution (solid 70 wt. %) | 6.4 parts |
| Alminium oxide ($Al_2O_3$) particles (0.3 $\mu$m, $10^{14}$ $\Omega \cdot$ cm of specific resistance) | 24.5 parts |
| Toluene | 215 parts |
| Butyl cellosolve | 215 parts |

The mixture was dispersed using a homomixer for 10 minutes to obtain an acrylic resin solution. Then,

| | |
|---|---|
| Silicone type of resin solution (SR2410 made by Toray Dow-corning Ltd., solid 23 wt. %) | 63.9 parts |
| Amino silane (SH6020 made by Toray Dow-corning Ltd., solid 100 wt. %) | 0.3 parts |

were dispersed by agitator in a vessel for 5 minutes, and obtained silicone solution was added into the homomixer which including therein above prepared acrylic resin solution, then the mixture were further dispersed for 10 minutes to yield a coating layer-forming solution.

As core material, same ferrite powder as that used in Example 1 was coated by above prepared coating layer-forming solution so as to give 0.15 $\mu$m thickness of coated layer, with using SPIRA COTA(Registered trademark by OKADA SEIKO Co. Ltd.).

Obtained carrier was baked in an electric furnace at 150° C. for one hour. After allowed to cool, the ferrite powder bulk was pulverized using a metal sieve having 106 $\mu$m width openings to result a carrier. Thus obtained carrier was provided to the similar evaluations as that of Example 1. Resulted decrease amount in electric charge, decrease value in electric resistance, change degree in scooped up amount of the developer onto developing roller are shown in Table 2.

Example 4

| | |
|---|---|
| Acrylic resin solution (Acridic A-413-70S made by Dai Nippon Ink Chemical, solid 50 wt. %) | 21.0 parts |
| Guanamine solution (solid 70 wt. %) | 6.4 parts |
| Alminium oxide ($Al_2O_3$) particles (0.3 $\mu$m, $10^{14}$ $\Omega \cdot$ cm of specific resistance) | 120.0 parts |
| Toluene | 650 parts |
| Butyl cellosolve | 650 parts |

The mixture was dispersed using a homomixer for 10 minutes to obtain an acrylic resin solution. Then,

| | |
|---|---|
| Silicone type of resin solution (SR2410 made by Toray Dow-corning Ltd., solid 23 wt. %) | 63.9 parts |
| Amino silane (SH6020 made by Toray Dow-corning Ltd., solid 100 wt. %) | 0.3 parts |

were dispersed by agitator in a vessel for 5 minutes, and obtained silicone solution was added into the homomixer which including therein above prepared acrylic resin solution, then the mixture were further dispersed for 10 minutes to yield a coating layer-forming solution.

As core material, same ferrite powder as that used in Example 1 was coated by above prepared coating layer-forming solution so as to give 0.15 $\mu$m thickness of coated layer, with using SPIRA COTA(Registered trademark by OKADA SEIKO Co. Ltd.).

Obtained carrier was baked in an electric furnace at 150° C. for one hour. After allowed to cool, the ferrite powder bulk was pulverized using a metal sieve having 106 $\mu$m width openings to result a carrier. Thus obtained carrier was provided to the similar evaluations as that of Example 1.

Resulted decrease amount in electric charge, decrease value in electric resistance, change degree in scooped up amount of the developer onto developing roller are shown in Table 2.

Example 5

| | |
|---|---|
| Acrylic resin solution (Acridic A-606-50S made by Dai Nippon Ink Chemical, solid 50 wt. %) | 21.0 parts |
| Guanamine solution (solid 70 wt. %) | 6.4 parts |
| Titanium dioxide particles (0.3 $\mu$m, $10^7$ $\Omega \cdot$ cm of specific resistance) | 120.0 parts |
| Toluene | 650 parts |
| Butyl cellosolve | 650 parts |

The mixture was dispersed using a homomixer for 10 minutes to obtain an acrylic resin solution. Then,

| | |
|---|---|
| Silicone type of resin solution (SR2410 made by Toray Dow-corning Ltd., solid 23 wt. %) | 63.9parts |
| Amino silane (SH6020 made by Toray Dow-corning Ltd., solid 100 wt. %) | 0.3parts |

were dispersed by agitator in a vessel for 5 minutes, and obtained silicone solution was added into the homomixer which including therein above prepared acrylic resin solution, then the mixture were further dispersed for 10 minutes to yield a coating layer-forming solution.

As core material, same ferrite powder as that used in Example 1 was coated by above prepared coating layer-forming solution so as to give 0.15 $\mu$m thickness of coated layer, with using SPIRA COTA(Registered trademark by OKADA SEIKO Co. Ltd.).

Obtained carrier was baked in an electric furnace at 150° C. for one hour. After allowed to cool, the ferrite powder bulk was pulverized using a metal sieve having 106 $\mu$m width openings to result a carrier. Thus obtained carrier was provided to the similar evaluations as that of Example 1. Resulted decrease amount in electric charge, decrease value in electric resistance, change degree in scooped up amount of the developer onto developing roller are shown in Table 2.

Example 6

| | |
|---|---|
| Acrylic resin solution (Acridic A-418 made by Dai Nippon Ink Chemical, solid 50 wt. %) | 21.0 parts |
| Guanamine solution (solid 70 wt. %) | 6.4 parts |
| Zinc oxide particles (0.3 $\mu$m, $10^7$ $\Omega \cdot$ cm of specific resistance) | 120.0 parts |
| Toluene | 650 parts |
| Butyl cellosolve | 650 parts |

The mixture was dispersed using a homomixer for 10 minutes to obtain an acrylic resin solution. Then,

| | |
|---|---|
| Silicone type of resin solution (SR2410 made by Toray Dow-corning Ltd., solid 23 wt. %) | 63.9 parts |
| Amino silane (SH6020 made by Toray Dow-corning Ltd., solid 100 wt. %) | 0.3 parts |

were dispersed by agitator in a vessel for 5 minutes, and obtained silicone solution was added into the homomixer which including therein above prepared acrylic resin solution, then the mixture were further dispersed for 10 minutes to yield a coating layer-forming solution.

As core material, same ferrite powder as that used in Example 1 was coated by above prepared coating layer-forming solution so as to give 0.15 $\mu$m thickness of coated layer, with using SPIRA COTA(Registered trademark by OKADA SEIKO Co. Ltd.).

Obtained carrier was baked in an electric furnace at 150° C. for one hour. After allowed to cool, the ferrite powder bulk was pulverized using a metal sieve having 106 $\mu$m width openings to result a carrier. Thus obtained carrier was provided to the similar evaluations as that of Example 1. Resulted decrease amount in electric charge, decrease value in electric resistance, change degree in scooped up amount of the developer onto developing roller are shown in Table 2.

Example 7

| | |
|---|---|
| Acrylic resin solution (Hitaloid 2450 made by Hitachi Chemical Co. Ltd, solid 50 wt. %) | 21.0 parts |
| Guanamine solution (solid 70 wt. %) | 6.4 parts |
| Alminium oxide ($Al_2O_3$) particles (0.3 $\mu$m, $10^{14}$ $\Omega \cdot$ cm of specific resistance) | 120.0 parts |
| Toluene | 665 parts |
| Butyl cellosolve | 665 parts |

The mixture was dispersed using a homomixer for 10 minutes to obtain an acrylic resin solution. Then,

| | |
|---|---|
| Silicone type of resin solution (SR2410 made by Toray Dow-corning Ltd., solid 23 wt. %) | 63.9 parts |
| Amino silane (SH6020 made by Toray Dow-corning Ltd., solid 100 wt. %) | 0.3 parts |

were dispersed by agitator in a vessel for 5 minutes, and obtained silicone solution and 4.6 parts of carbon black (Black Perls 2000 by CABOT CORPORATION) were added into the homomixer which including therein above prepared acrylic resin solution, then the mixture were further dispersed for 10 minutes so as to yield a coating layer-forming solution which containing the carbon black dispersed homogeneously therein.

As core material, same ferrite powder as that used in Example 1 was coated by above prepared coating layer-forming solution so as to give 0.15 $\mu$m thickness of coated layer, with using SPIRA COTA(Registered trademark by OKADA SEIKO Co. Ltd.).

Obtained carrier was baked in an electric furnace at 150° C. for one hour. After allowed to cool, the ferrite powder bulk was pulverized using a metal sieve having 106 $\mu$m width openings to result a carrier. Thus obtained carrier was provided to the similar evaluations as that of Example 1. Resulted decrease amount in electric charge, decrease value in electric resistance, change degree in scooped up amount of the developer onto developing roller are shown in Table 2.

Example 8

| | |
|---|---|
| Acrylic resin solution (Hitaloid 3001 made by Hitachi Chemical Co. Ltd, solid 50 wt. %) | 21.0 parts |
| Guanamine solution (solid 70 wt. %) | 6.4 parts |
| Alminium oxide ($Al_2O_3$) particles (0.3 $\mu$m, $10^{14}$ $\Omega \cdot$ cm of specific resistance) | 120.0 parts |
| Toluene | 665 parts |
| Butyl cellosolve | 665 parts |

The mixture was dispersed using a homomixer for 10 minutes to obtain an acrylic resin solution. Then,

| | |
|---|---|
| Silicone type of resin solution (SR2410 made by Toray Dow-corning Ltd., solid 23 wt. %) | 63.9 parts |
| Amino silane (SH6020 made by Toray Dow-corning Ltd., solid 100 wt. %) | 0.3 parts |

were dispersed by agitator in a vessel for 5 minutes, and obtained silicone solution was added into the homomixer which including therein above prepared carbon black containing acrylic resin solution, then the mixture were further dispersed for 10 minutes so as to yield a coating layer-forming solution which containing the carbon black dispersed homogeneously in the merely acrylic resin.

As core material, same ferrite powder as that used in Example 1 was coated by above prepared coating layer-forming solution so as to give 0.15 $\mu$m thickness of coated layer, with using SPIRA COTA(Registered trademark by OKADA SEIKO Co. Ltd.).

Obtained carrier was baked in an electric furnace at 150° C. for one hour. After allowed to cool, the ferrite powder bulk was pulverized using a metal sieve having 106 $\mu$m width openings to result a carrier. Thus obtained carrier was provided to the similar evaluations as that of Example 1. Resulted decrease amount in electric charge, decrease value in electric resistance, change degree in scooped up amount of the developer onto developing roller are shown in Table 2.

Comparative Example 1

| | |
|---|---|
| Acrylic resin solution (Acridic A-405 made by Dai Nippon Ink Chemical, solid 50 wt. %) | 2.2 parts |
| Guanamine solution (solid 70 wt. %) | 0.6 parts |
| Alnimium oxide ($Al_2O_3$) particles (0.1 $\mu$m, $10^{14}$ $\Omega \cdot$ cm of specific resistance) | 24.5 parts |
| Toluene | 200 parts |
| Butyl cellosolve | 200 parts |

The mixture was dispersed using a homomixer for 10 minutes to obtain an acrylic resin solution. Then,

| | |
|---|---|
| Silicone type of resin solution (SR2410 made by Toray Dow-corning Ltd., solid 23 wt. %) | 121.7 parts |
| Amino silane (SH6020 made by Toray Dow-corning Ltd., solid 100 wt. %) | 0.5 parts |

were dispersed by agitator in a vessel for 5 minutes, and obtained silicone solution was added into the homomixer which including therein above prepared acrylic resin solution, then the mixture were further dispersed for 10 minutes to yield a coating layer-forming solution.

As core material, same ferrite powder as that used in Example 1 was coated by above prepared coating layer-forming solution so as to give 0.15 $\mu$m thickness of coated layer, with using SPIRA COTA(Registered trademark by OKADA SEIKO Co. Ltd.).

Obtained carrier was baked in an electric furnace at 150° C. for one hour. After allowed to cool, the ferrite powder bulk was pulverized using a metal sieve having 106 $\mu$m width openings to result a carrier. Thus obtained carrier was provided to the similar evaluations as that of Example 1. Resulted decrease amount in electric charge, decrease value in electric resistance, change degree in scooped up amount of the developer onto developing roller are shown in Table 2.

Comparative Example 2

| | |
|---|---|
| Acrylic resin solution (Acridic A-322 made by Dai Nippon Ink Chemical, solid 50 wt. %) | 40.0 parts |
| Guanamine solution (solid 70 wt. %) | 12.1 parts |
| Alnimium oxide ($Al_2O_3$) particles (0.1 $\mu$m, $10^{14}$ $\Omega \cdot$ cm of specific resistance) | 24.5 parts |
| Toluene | 230 parts |
| Butyl cellosolve | 230 parts |

The mixture was dispersed using a homomixer for 10 minutes to obtain an acrylic resin solution. Then,

| | |
|---|---|
| Silicone type of resin solution (SR2410 made by Toray Dow-corning Ltd., solid 23 wt. %) | 6.4 parts |
| Amino silane (SH6020 made by Toray Dow-corning Ltd., solid 100 wt. %) | 0.03 parts |

were dispersed by agitator in a vessel for 5 minutes, and obtained silicone solution was added into the homomixer which including therein above prepared acrylic resin solution, then the mixture were further dispersed for 10 minutes to yield a coating layer-forming solution.

As core material, same ferrite powder as that used in Example 1 was coated by above prepared coating layer-forming solution so as to give 0.15 $\mu$m thickness of coated layer, with using SPIRA COTA(Registered trademark by OKADA SEIKO Co. Ltd.).

Obtained carrier was baked in an electric furnace at 150° C. for one hour. After allowed to cool, the ferrite powder bulk was pulverized using a metal sieve having 106 $\mu$m width openings to result a carrier. Thus obtained carrier was provided to the similar evaluations as that of Example 1. Resulted decrease amount in electric charge, decrease value in electric resistance, change degree in scooped up amount of the developer onto developing roller are shown in Table 2.

Comparative Example 3

| | |
|---|---|
| Acrylic resin solution (Acridic A-418 made by Dai Nippon Ink Chemical, solid 50 wt. %) | 21.0 parts |
| Guanamine solution (solid 70 wt. %) | 6.4 parts |
| Alnimium oxide ($Al_2O_3$) particles (0.1 $\mu$m, $10^{14}$ $\Omega \cdot$ cm of specific resistance) | 24.5 parts |
| Toluene | 215 parts |
| Butyl cellosolve | 215 parts |

The mixture was dispersed using a homomixer for 10 minutes to obtain an acrylic resin solution. Then,

| | |
|---|---|
| Silicone type of resin solution (SR2410 made by Toray Dow-corning Ltd., solid 23 wt. %) | 63.9 parts |
| Amino silane (SH6020 made by Toray Dow-corning Ltd., solid 100 wt. %) | 0.3 parts |

were dispersed by agitator in a vessel for 5 minutes, and obtained silicone solution was added into the homomixer which including therein above prepared acrylic resin solution, then the mixture were further dispersed for 10 minutes to yield a coating layer-forming solution.

As core material, same ferrite powder as that used in Example 1 was coated by above prepared coating layer-forming solution so as to give 0.15 $\mu$m thickness of coated layer, with using SPIRA COTA(Registered trademark by OKADA SEIKO Co. Ltd.).

Obtained carrier was baked in an electric furnace at 150° C. for one hour. After allowed to cool, the ferrite powder bulk was pulverized using a metal sieve having 106 $\mu$m width openings to result a carrier. Thus obtained carrier was provided to the similar evaluations as that of Example 1. Resulted decrease amount in electric charge, decrease value in electric resistance, change degree in scooped up amount of the developer onto developing roller are shown in Table 2.

TABLE 1

| | acrylic resin | fine particles | | | | | | |
|---|---|---|---|---|---|---|---|---|
| | | Particle | | layer | | fine | carbon black | |
| | ratio (wt. %) | diameter: D ($\mu$m) | amount (wt. %) | thickness: h ($\mu$m) | D/h | particle material | amount (wt. %) | existing location |
| Ex. 1 | 50 | — | 0 | 0.15 | — | — | 0 | — |
| Ex. 2 | 50 | 0.1 | 45 | 0.15 | 0.7 | $Al_2O_3$ | 0 | — |
| Ex. 3 | 50 | 0.3 | 45 | 0.15 | 2.0 | $Al_2O_3$ | 0 | — |
| Ex. 4 | 50 | 0.3 | 80 | 0.15 | 2.0 | $Al_2O_3$ | 0 | — |
| Ex. 5 | 50 | 0.3 | 80 | 0.15 | 2.0 | $TiO_2$ | 0 | — |
| Ex. 6 | 50 | 0.3 | 80 | 0.15 | 2.0 | ZnO | 0 | — |
| Ex. 7 | 50 | 0.3 | 80 | 0.15 | 2.0 | $Al_2O_3$ | 3 | silicone-acrylic layer |
| Ex. 8 | 50 | 0.3 | 80 | 0.15 | 2.0 | $Al_2O_3$ | 3 | acrylic layer |
| Com. Ex. 1 | 5 | 0.1 | 45 | 0.15 | 0.7 | $Al_2O_3$ | 0 | — |
| Com. Ex. 2 | 95 | 0.1 | 45 | 0.15 | 0.7 | $Al_2O_3$ | 0 | — |
| Com. Ex. 3 | 50 | 1.0 | 45 | 0.15 | 6.7 | $Al_2O_3$ | 0 | — |

TABLE 2

| | physical properties of carrier at initial stage | | | physical properties of carrier after 300,000 sheets run developing | decreased | |
|---|---|---|---|---|---|---|
| | tribo-charge amount ($\mu$c/g) | specific electric resistance Log ($\Omega \cdot$ cm) | amount of developer scooped up onto (mg/cm$^2$) | roller decreased amount of tribo-charge ($\mu$c/g) | value in specific electric resistance Log ($\Omega \cdot$ cm) | amount of developer scooped up onto (mg/cm$^2$) |
| Ex. 1 | 29.7 | 11.98 | 70 | 4.6 | 1.86 | 55 |
| Ex. 2 | 27.4 | 13.83 | 70 | 4.5 | 1.92 | 56 |
| Ex. 3 | 28.6 | 13.59 | 70 | 3.4 | 1.57 | 59 |
| Ex. 4 | 23.1 | 15.37 | 70 | 2.3 | 1.24 | 63 |
| Ex. 5 | 15.4 | 13.41 | 70 | 2.1 | 1.17 | 62 |
| Ex. 6 | 15.6 | 13.28 | 70 | 2.4 | 1.26 | 63 |
| Ex. 7 | 13.1 | 12.79 | 70 | 2.1 | 0.98 | 63 |
| Ex. 8 | 12.3 | 12.04 | 70 | 2.3 | 1.14 | 62 |

TABLE 2-continued

| | physical properties of carrier at initial stage | | | physical properties of carrier after 300,000 sheets run developing | decreased | |
|---|---|---|---|---|---|---|
| | tribo-charge amount (μc/g) | specific electric resistance Log (Ω · cm) | amount of developer scooped up onto (mg/cm²) | roller decreased amount of tribo-charge (μc/g) | value in specific electric resistance Log (Ω · cm) | amount of developer scooped up onto (mg/cm²) |
| Com. Ex. 1 | 32.8 | 14.57 | 70 | exhausted lifetime at 80,000 sheets run (decreased in electric resistance) | | 35 |
| Com. Ex. 2 | 22.6 | 13.15 | 70 | exhausted lifetime at 120,000 sheets run (decreased in tribo-charge) | | 58 |
| Com. Ex. 3 | 25.2 | 14.73 | 70 | 6.3 | 3.16 | 45 |

From both Tables 1 and 2, following regards are understood. Namely, Example 1, in which coating resin consisted of acrylic resin and silicone resin and amount of the acrylic resin was 50 wt. %, gave good performances that the decrease amount in electric charge of the carrier, the decrease value in resistance of the carrier, and the change degree in scooped up amount of the developer onto developing roller were within objective values respectively, resulting excellent effects. Example 2, in which an amount of 45 wt. % of $Al_2O_3$ particles having a relative size figure represented by [D/h] of 0.7 were contained, was able to stand comparison with Example 1 regarding to the points of decrease amount in electric charge of the carrier, decrease value in resistance of the carrier, and change degree in scooped up amount of the developer onto developing roller, while the effect of the $Al_2O_3$ particles contained was not outstanding. Example 3, in which $Al_2O_3$ particles having a relative size figure represented by [D/h] of 2.0 were contained, gave good performances that decrease amount in electric charge of the carrier, decrease value in resistance of the carrier, and change degree in scooped up amount of the developer onto developing roller were within objective values respectively, resulting excellent effects. Example 4, in which contained fine particles were in an amount of 80 wt. % of $Al_2O_3$ particles, gave good performances that decrease amount in electric charge of the carrier, decrease value in resistance of the carrier, and change degree in scooped up amount of the developer onto developing roller were within objective values respectively, resulting excellent effects. Example 5, in which contained fine particles were $TiO_2$ instead of $Al_2O_3$ in Example 4, gave good performances that decrease amount in electric charge of the carrier, decrease value in resistance of the carrier, and change degree in scooped up amount of the developer onto developing roller were within objective values respectively, resulting excellent effects. Example 6, in which contained fine particles were ZnO instead of $Al_2O_3$ in Example 4, gave good performances that decrease amount in electric charge of the carrier, decrease value in resistance of the carrier, and change degree in scooped up amount of the developer onto developing roller were within objective values respectively, resulting excellent effects. Example 7, in which contained fine particles were carbon black particles dispersed in both coating resins instead of $Al_2O_3$ in Example 4, gave good performances that decrease amount in electric charge of the carrier, decrease value in resistance of the carrier, and change degree in scooped up amount of the developer onto developing roller were within objective values respectively, resulting excellent effects. Example 8, in which contained fine particles were carbon black particles dispersed in merely acrylic resin in coating layer instead of $Al_2O_3$ in Example 4, gave good performances that decrease amount in electric charge of the carrier, decrease value in resistance of the carrier, and change degree in scooped up amount of the developer onto developing roller were within objective values respectively, resulting excellent effects On the other hand, Comparative Example 1, which was a similar Example as Example 2 excepting a point of employed acrylic resin in an amount of 5 wt. %, caused severe layer-scraping, therefore made significant image deterioration to a level of impossible practical use at 80000 paper sheets run, thus was not able to help stopping thereafter run. Comparative Example 2, which was a similar Example as Example 2 excepting a point of employed acrylic resin in an amount of 95 wt. %, gave a small change degree can reach to the objective value in scooped up amount of the developer onto developing roller, however gave a severe decrease of tribo-charge, therefore made significant image deterioration to a level of impossible practical use at 120000 paper sheets run, thus was not able to help stopping thereafter run. Comparative Example 3, which was a similar Example as Example 2 excepting a point of employed fine particles having a relative size figure represented by [D/h] of 6.7, barely gave the change degree arrived to the objective value in scooped up amount of the developer onto developing roller, however gave significant deteriorated values in both the decrease amount in electric charge of the carrier, and the decrease value in resistance of the carrier, to a level of impossible practical use.

Example 9

| | |
|---|---|
| Silicone type of resin solution (SR2410 made by Toray Dow-corning Ltd., solid 23 wt. %) | 20.0 parts |
| Amino silane (SH6020 made by Toray Dow-corning Ltd., solid 100 wt. %) | 0.1 parts |
| Toluene | 25 parts |

were dispersed by agitator in a vessel for 5 minutes, to obtain a silicone resin solution.

As core material, calcined ferrite powder(F-300 made by Powdertech Co. Ltd, average particle diameter 50 μm) was coated by above prepared silicone resin coating layer-forming solution, with using SPIRA COTA(Registered trademark by OKADA SEIKO Co. Ltd.), and it was dried to give a coated layer. Then,

| | |
|---|---|
| Acrylic resin solution (Hitaloid 3057A made by Hitachi Chemical Co. Ltd, solid 50 wt. %) | 36.0 parts |
| Guanamine solution (solid 70 wt. %) | 11.0 parts |
| Toluene | 105 parts |
| Butyl cellosolve | 105 parts |

were dispersed using a homomixer for 10 minutes to obtain an acrylic resin solution. The acrylic resin solution was coated onto above silicone resin-coated carrier so as to give a coated layer having a total layer thickness of 0.15 μm using SPIRA COTA(Registered trademark by OKADA SEIKO Co. Ltd.).

Obtained carrier was baked in an electric furnace at 150° C. for one hour. After allowed to cool, the ferrite powder bulk was pulverized using a metal sieve having 106 μm width openings to result a carrier.

Similar evaluations as that of above Example 1 were conducted. Namely, as picture by transmission electron microscope (TEM) can reveal visible state of cross sections of carrier particles, thickness of the coated resin layer was determined by observing cross sections of carrier particles using TEM, and calculating average thickness from obtained thickness data.

Carrier obtained by above described method was mixed with a toner to produce a 380 g of developer having 5 wt. % of toner concentration, then which was set upon a commercially available digital full color copy machine which was a remodeled one of Imagio Color 2800 (registered trademark by Ricoh Company Ltd.), evaluations of 300,000 paper sheets of run were made with reproductions having single black color. With regard to the carrier after finishing the 300,000 sheets of run, a decrease amount in electric charge of the carrier, a decrease value in resistance of the carrier, a change degree in scooped up amount of the developer onto developing roller were examined, resultants are shown in Table 4.

The "decrease amount in electric charge of the carrier" means a variance amount between electric charge amount (Q1) of carrier in developer sample at initial stage which being mixed and agitate 95 wt. % of the carrier to 5 wt. % of the toner to make them tribo-electrically charged, and electric charge amount (Q2) of carrier obtained by blowing-off toner particles remained in the developer after 300,000 paper sheets run, objective value of the decrease amount in electric charge of the carrier was of within 5.0 (μc/g). Both electric charge amounts (Q1) and (Q2) were measured by a blow-off method using the TB-200 manufactured by Toshiba Chemical Corp. Ltd. The decrease in electric charge of the carrier is mainly caused by toner spent on the carrier surface, therefore the decrease in electric charge of the carrier can mitigate by suppressing the toner spent.

The "decrease value in resistance of carrier" means a variance value between volumetric resistance value converted from measured resistance of carrier in developer sample at initial stage (R1)by use of high resist-meter and volumetric resistance value of carrier obtained by blowing-off toner particles remained in the developer after 300,000 paper sheets run(R2) by use of high resist-meter, objective value of the decrease value in resistance of carrier was of within 2.0 Log (Ω·cm). Both volumetric resistance values (R1) and (R2) were measured by steps consisting of placing the carrier sample in the space between parallel electrodes for measuring resistance, imposing electric voltage of DC 250V to the sample, and after 30 seconds of time lapse measuring electric resistance after time lapse of 30 seconds. The decrease in electric resistance of carrier is mainly caused by layer-scraping of coated resin, therefore the decrease in electric resistance of carrier can mitigate by suppressing the layer-scraping.

Example 10

| | |
|---|---|
| Acrylic resin solution (Hitaloid D1004 made by Hitachi Chemical Co. Ltd, solid 50 wt. %) | 21.0 parts |
| Guanamine solution (solid 70 wt. %) | 6.5 parts |
| Toluene | 60 parts |
| Butyl cellosolve | 60 parts |

were dispersed using a homomixer for 10 minutes to obtain an acrylic resin solution.

As core material, calcined ferrite powder(F-300 made by Powdertech Co. Ltd, average particle diameter 50 μm) was coated by above prepared acrylic resin coating layer-forming solution, with using SPIRA COTA(Registered trademark by OKADA SEIKO Co. Ltd.), and it was dried to give a coated layer. Then,

| | |
|---|---|
| Silicone type of resin solution (SR2410 made by Toray Dow-corning Ltd., solid 23 wt. %) | 65.0 parts |
| Amino silane (SH6020 made by Toray Dow-corning Ltd., solid 100 wt. %) | 0.3 parts |
| Toluene | 90 parts |

were dispersed by agitator in a vessel for 5 minutes, to obtain a silicone resin solution. The silicone resin solution was coated onto above acrylic resin-coated carrier so as to give a coated layer having a total layer thickness of 0.15 μm using SPIRA COTA(Registered trademark by OKADA SEIKO Co. Ltd.).

Obtained carrier was baked in an electric furnace at 150° C. for one hour. After allowed to cool, the ferrite powder bulk was pulverized using a metal sieve having 106 μm width openings to result a carrier. Thus obtained carrier was provided to the similar evaluations as that of Example 9. Resulted decrease amount in electric charge, decrease value in electric resistance, change degree in scooped up amount of the developer onto developing roller are shown in Table 4.

Example 11

| | |
|---|---|
| Acrylic resin solution (Hitaloid 3368 made by Hitachi Chemical Co. Ltd, solid 50 wt. %) | 21.0 parts |
| Guanamine solution (solid 70 wt. %) | 6.5 parts |
| Aluminum oxide($Al_2O_3$) particles (0.3 $\mu$m, $10^{14}$ $\Omega \cdot$ cm of specific resistance) | 120 parts |
| Toluene | 600 parts |
| Butyl cellosolve | 600 parts |

were dispersed using a homomixer for 10 minutes, to obtain an acrylic resin solution.

As core material, calcined ferrite powder(F-300 made by Powdertech Co. Ltd, average particle diameter 50 $\mu$m) was employed, which was coated by above prepared acrylic resin coating layer-forming solution, with using SPIRA COTA (Registered trademark by OKADA SEIKO Co. Ltd.), and it was dried to give a coated layer. Then,

| | |
|---|---|
| Silicone type of resin solution (SR2410 made by Toray Dow-corning Ltd., solid 23 wt. %) | 65.0 parts |
| Amino silane (SH6020 made by Toray Dow-corning Ltd., solid 100 wt. %) | 0.3 parts |
| Toluene | 90 parts |

were dispersed by agitator in a vessel for 5 minutes, to obtain a silicone resin solution. The silicone resin solution was coated onto acrylic resin-coating layer of the carrier, so as to give a coated layer having a total layer thickness of 0.15 $\mu$m using SPIRA COTA(Registered trademark by OKADA SEIKO Co. Ltd.).

Obtained carrier was baked in an electric furnace at 150° C. for one hour. After allowed to cool, the ferrite powder bulk was pulverized using a metal sieve having 106 $\mu$m width openings to result a carrier. Thus obtained carrier was provided to the similar evaluations as that of Example 9. Resulted decrease amount in electric charge, decrease value in electric resistance, change degree in scooped up amount of the developer onto developing roller are shown in Table 4.

Example 12

| | |
|---|---|
| Acrylic resin solution (S-4090 made by TOAGOSEI Co. Ltd, solid 50 wt. %) | 21.0 parts |
| Guanamine solution (solid 70 wt. %) | 6.5 parts |
| Titanium dioxide ($TiO_2$) particles (0.3 $\mu$m, $10^7$ $\Omega \cdot$ cm of specific resistance) | 120.0 parts |
| Toluene | 600 parts |
| Butyl cellosolve | 600 parts |

were dispersed using a homomixer for 10 minutes, to obtain an acrylic resin solution.

As core material, calcined ferrite powder(F-300 made by Powdertech Co. Ltd, average particle diameter 50 $\mu$m) was employed, which was coated by above prepared acrylic resin coating layer-forming solution, with using SPIRA COTA (Registered trademark by OKADA SEIKO Co. Ltd.), and it was dried to give a coated layer. Then,

| | |
|---|---|
| Silicone type of resin solution (SR2410 made by Toray Dow-corning Ltd., solid 23 wt. %) | 65.0 parts |
| Amino silane (SH6020 made by Toray Dow-corning Ltd., solid 100 wt. %) | 0.3 parts |
| Toluene | 90 parts |

were dispersed by agitator in a vessel for 5 minutes, to obtain a silicone resin solution. The silicone resin solution was coated onto the acrylic resin-coating layer of the carrier, so as to give a coated layer having a total layer thickness of 0.15 $\mu$m using SPIRA COTA(Registered trademark by OKADA SEIKO Co. Ltd.).

Obtained carrier was baked in an electric furnace at 150° C. for one hour. After allowed to cool, the ferrite powder bulk was pulverized using a metal sieve having 106 $\mu$m width openings to result a carrier. Thus obtained carrier was provided to the similar evaluations as that of Example 9. Resulted decrease amount in electric charge, decrease value in electric resistance, change degree in scooped up amount of the developer onto developing roller are shown in Table 4.

Example 13

| | |
|---|---|
| Acrylic resin solution (ALMATEX784 made by MITSUI CHEMICALS INC, solid 50 wt. %) | 21.0 parts |
| Guanamine solution (solid 70 wt. %) | 6.5 parts |
| Zinc oxide particles (0.3 $\mu$m, $10^7$ $\Omega \cdot$ cm of specific resistance) | 120.0 parts |
| Toluene | 600 parts |
| Butyl cellosolve | 600 parts |

were dispersed using a homomixer for 10 minutes, to obtain an acrylic resin solution.

As core material, calcined ferrite powder(F-300 made by Powdertech Co. Ltd, average particle diameter 50 $\mu$m) was employed, and which was coated by above prepared acrylic resin coating layer-forming solution, with using SPIRA COTA(Registered trademark by OKADA SEIKO Co. Ltd.), and it was dried to give a coated layer. Then,

| | |
|---|---|
| Silicone type of resin solution (SR2410 made by Toray Dow-corning Ltd., solid 23 wt. %) | 65.0 parts |
| Amino silane (SH6020 made by Toray Dow-corning Ltd., solid 100 wt. %) | 0.3 parts |
| Toluene | 90 parts |

were dispersed by agitator in a vessel for 5 minutes, to obtain a silicone resin solution. The silicone resin solution was coated onto the acrylic resin-coating layer of the carrier, so as to give a coated layer having a total layer thickness of 0.15 $\mu$m using SPIRA COTA(Registered trademark by OKADA SEIKO Co. Ltd.).

Obtained carrier was baked in an electric furnace at 150° C. for one hour. After allowed to cool, the ferrite powder bulk was pulverized using a metal sieve having 106 $\mu$m width openings to result a carrier. Thus obtained carrier was provided to the similar evaluations as that of Example 9. Resulted decrease amount in electric charge, decrease value in electric resistance, change degree in scooped up amount of the developer onto developing roller are shown in Table 4.

Example 14

| | |
|---|---|
| Acrylic resin solution (ALMATEX D151 made by MITSUI CHEMICALS INC, solid 50 wt. %) | 21.0 parts |
| Guanamine solution (solid 70 wt. %) | 6.5 parts |
| Aluminum oxide ($Al_2O_3$) particles (0.3 $\mu$m, $10^{14}$ $\Omega \cdot$ cm of specific resistance) | 120.0 parts |
| Carbon black (Black Perls 2000 made by CABOT CORPORATION) | 2.3 parts |
| Toluene | 620 parts |
| Butyl cellosolve | 620 parts |

were dispersed using a homomixer for 10 minutes, to obtain an acrylic resin solution.

As core material, calcined ferrite powder(F-300 made by Powdertech Co. Ltd, average particle diameter 50 $\mu$m) was employed, which was coated by above prepared acrylic resin coating layer-forming solution to give a coated layer, with using SPIRA COTA(Registered trademark by OKADA SEIKO Co. Ltd.), and it was dried to give a coated layer. Then,

| | |
|---|---|
| Silicone type of resin solution (SR2410 made by Toray Dow-corning Ltd., solid 23 wt. %) | 65.0 parts |
| Amino silane (SH6020 made by Toray Dow-corning Ltd., solid 100 wt. %) | 0.3 parts |
| Carbon black (Black Perls 2000 made by CABOT CORPORATION) | 2.3 parts |
| Toluene | 130 parts |

were dispersed by agitator in a vessel for 5 minutes, to obtain a silicone resin solution. The silicone resin solution was coated onto the acrylic resin-coating layer of the carrier, so as to give a coated layer having a total layer thickness of 0.15 $\mu$m using SPIRA COTA(Registered trademark by OKADA SEIKO Co. Ltd.).

Obtained carrier was baked in an electric furnace at 150° C. for one hour. After allowed to cool, the ferrite powder bulk was pulverized using a metal sieve having 106 $\mu$m width openings to result a carrier. Thus obtained carrier was provided to the similar evaluations as that of Example 9. Resulted decrease amount in electric charge, decrease value in electric resistance, change degree in scooped up amount of the developer onto developing roller are shown in Table 4.

Example 15

| | |
|---|---|
| Acrylic resin solution (ALMATEX 894-2 made by MITSUI CHEMICALS INC, solid 50 wt. %) | 21.0 parts |
| Guanamine solution (solid 70 wt. %) | 6.5 parts |
| Aluminum oxide ($Al_2O_3$) particles (0.3 $\mu$m, $10^{14}$ $\Omega \cdot$ cm of specific resistance) | 120.0 parts |
| Carbon black (Black Perls 2000 made by CABOT CORPORATION) | 4.6 parts |
| Toluene | 620 parts |
| Butyl cellosolve | 620 parts |

were dispersed using a homomixer for 10 minutes, to obtain an acrylic resin solution.

As core material, calcined ferrite powder(F-300 made by Powdertech Co. Ltd, average particle diameter 50 $\mu$m) was employed, which was coated by above prepared acrylic resin coating layer-forming solution to give a coated layer, with using SPIRA COTA(Registered trademark by OKADA SEIKO Co. Ltd.), and it was dried to give a coated layer. Then,

| | |
|---|---|
| Silicone type of resin solution (SR2410 made by Toray Dow-corning Ltd., solid 23 wt. %) | 65.0 parts |
| Amino silane (SH6020 made by Toray Dow-corning Ltd., solid 100 wt. %) | 0.3 parts |
| Toluene | 90 parts |

were dispersed by agitator in a vessel for 5 minutes, to obtain a silicone resin solution. The silicone resin solution was coated onto the acrylic resin-coating layer of the carrier, so as to give a coated layer having a total layer thickness of 0.15 $\mu$m using SPIRA COTA(Registered trademark by OKADA SEIKO Co. Ltd.).

Obtained carrier was baked in an electric furnace at 150° C. for one hour. After allowed to cool, the ferrite powder bulk was pulverized using a metal sieve having 106 $\mu$m width openings to result a carrier. Thus obtained carrier was provided to the similar evaluations as that of Example 9. Resulted decrease amount in electric charge, decrease value in electric resistance, change degree in scooped up amount of the developer onto developing roller are shown in Table 4.

Comparative Example 4

| | |
|---|---|
| Acrylic resin solution (HITALOID3368 made by Hitachi Chemical Co. Ltd., solid 50 wt. %) | 2.0 parts |
| Guanamine solution (solid 70 wt. %) | 0.7 parts |
| Toluene | 10 parts |
| Butyl cellosolve | 10 parts |

were dispersed using a homomixer for 10 minutes, to obtain an acrylic resin solution.

As core material, calcined ferrite powder(F-300 made by Powdertech Co. Ltd, average particle diameter 50 $\mu$m) was employed, which was coated by above prepared acrylic resin coating layer-forming solution to give a coated layer, with using SPIRA COTA(Registered trademark by OKADA SEIKO Co. Ltd.), and it was dried to give a coated layer. Then,

| | |
|---|---|
| Silicone type of resin solution (SR2410 made by Toray Dow-corning Ltd., solid 23 wt. %) | 124.0 parts |
| Amino silane (SH6020 made by Toray Dow-corning Ltd., solid 100 wt. %) | 0.6 parts |
| Toluene | 170 parts |

were dispersed by agitator in a vessel for 5 minutes, to obtain a silicone resin solution. The silicone resin solution was coated onto the acrylic resin-coating layer of the carrier, so as to give a coated layer having a total layer thickness of 0.15 $\mu$m using SPIRA COTA(Registered trademark by OKADA SEIKO Co. Ltd.).

Obtained carrier was baked in an electric furnace at 150° C. for one hour. After allowed to cool, the ferrite powder bulk was pulverized using a metal sieve having 106 $\mu$m width openings to result a carrier. Thus obtained carrier was provided to the similar evaluations as that of Example 9.

Resulted decrease amount in electric charge, decrease value in electric resistance, change degree in scooped up amount of the developer onto developing roller are shown in Table 4.

Comparative Example 5

| | |
|---|---|
| Acrylic resin solution (ALMATEX 784 made by MITSUI CHEMICALS INC, solid 50 wt. %) | 40.0 parts |
| Guanamine solution (solid 70 wt. %) | 12.0 parts |
| Toluene | 120 parts |
| Butyl cellosolve | 120 parts |

were dispersed using a homomixer for 10 minutes, to obtain an acrylic resin solution.

As core material, calcined ferrite powder(F-300 made by Powdertech Co. Ltd, average particle diameter 50 μm) was employed, which was coated by above prepared acrylic resin coating layer-forming solution to give a coated layer, with using SPIRA COTA(Registered trademark by OKADA SEIKO Co. Ltd.), and it was dried to give a coated layer. Then,

| | |
|---|---|
| Silicone type of resin solution (SR2410 made by Toray Dow-corning Ltd., solid 23 wt. %) | 6.5 parts |
| Amino silane (SH6020 made by Toray Dow-corning Ltd., solid 100 wt. %) | 0.03 parts |
| Toluene | 10 parts |

were dispersed by agitator in a vessel for 5 minutes, to obtain a silicone resin solution. The silicone resin solution was coated onto the acrylic resin-coating layer of the carrier, so as to give a coated layer having a total layer thickness of 0.15 μm using SPIRA COTA(Registered trademark by OKADA SEIKO Co. Ltd.).

Obtained carrier was baked in an electric furnace at 150° C. for one hour. After allowed to cool, the ferrite powder bulk was pulverized using a metal sieve having 106 μm width openings to result a carrier. Thus obtained carrier was provided to the similar evaluations as that of Example 9. Resulted decrease amount in electric charge, decrease value in electric resistance, change degree in scooped up amount of the developer onto developing roller are shown in Table 4.

Comparative Example 6

| | |
|---|---|
| Acrylic resin solution (ALMATEX D151 made by MITSUI CHEMICALS INC, solid 50 wt. %) | 21.0 parts |
| Guanamine solution (solid 70 wt. %) | 6.5 parts |
| Aluminum oxide ($Al_2O_3$) particles (1.0 μm, $10^{14}$ Ω · cm of specific resistance) | 120.0 parts |
| Toluene | 600 parts |
| Butyl cellosolve | 600 parts |

were dispersed using a homomixer for 10 minutes, to obtain an acrylic resin solution.

As core material, calcined ferrite powder(F-300 made by Powdertech Co. Ltd, average particle diameter 50 μm) was employed, which was coated by above prepared acrylic resin coating layer-forming solution to give a coated layer, with using SPIRA COTA(Registered trademark by OKADA SEIKO Co. Ltd.), and it was dried to give a coated layer. Then,

| | |
|---|---|
| Silicone type of resin solution (SR2410 made by Toray Dow-corning Ltd., solid 23 wt. %) | 65.0 parts |
| Amino silane (SH6020 made by Toray Dow-corning Ltd., solid 100 wt. %) | 0.3 parts |
| Toluene | 90 parts |

were dispersed by agitator in a vessel for 5 minutes, to obtain a silicone resin solution. The silicone resin solution was coated onto the acrylic resin-coating layer of the carrier, so as to give a coated layer having a total layer thickness of 0.15 μm using SPIRA COTA(Registered trademark by OKADA SEIKO Co. Ltd.).

Obtained carrier was baked in an electric furnace at 150° C. for one hour. After allowed to cool, the ferrite powder bulk was pulverized using a metal sieve having 106 μm width openings to result a carrier. Thus obtained carrier was provided to the similar evaluations as that of Example 9. Resulted decrease amount in electric charge, decrease value in electric resistance, change degree in scooped up amount of the developer onto developing roller are shown in Table 4.

TABLE 3

| | acrylic resin ratio (wt. %) | resin layer being contacted with carrir | upper resin layer | fine particles particle diameter: D (μm) | fine particles amount (wt. %) | layer thickness: h (μm) | D/h | fine particle material | carbon black amount (wt. %) | carbon black existing location |
|---|---|---|---|---|---|---|---|---|---|---|
| Ex. 9 | 85 | silicone resin | acrylic resin | — | 0 | 0.15 | — | — | 0 | — |
| Ex. 10 | 50 | acrylic resin | silicone resin | — | 0 | 0.15 | — | — | 0 | — |
| Ex. 11 | 50 | acrylic resin | silicone resin | 0.3 | 80 | 0.15 | 2.0 | $Al_2O_3$ | 0 | — |
| Ex. 12 | 50 | acrylic resin | silicone resin | 0.3 | 80 | 0.15 | 2.0 | $TiO_2$ | 0 | — |

TABLE 3-continued

| | acrylic resin ratio (wt. %) | resin layer being contacted with carrir | upper resin layer | fine particles particle diameter: D (μm) | fine particles amount (wt. %) | layer thickness: h (μm) | D/h | fine particle material | carbon black amount (wt. %) | carbon black existing location |
|---|---|---|---|---|---|---|---|---|---|---|
| Ex. 13 | 50 | acrylic resin | silicone resin | 0.3 | 80 | 0.15 | 2.0 | ZnO | 0 | — |
| Ex. 14 | 50 | acrylic resin | silicone resin | 0.3 | 80 | 0.15 | 2.0 | $Al_2O_3$ | 3 | silicone-acrylic layer |
| Ex. 15 | 50 | acrylic resin | silicone resin | 0.3 | 80 | 0.15 | 2.0 | $Al_2O_3$ | 3 | acrylic layer |
| Com. Ex. 4 | 5 | acrylic resin | silicone resin | — | 0 | 0.15 | — | — | 0 | — |
| Com. Ex. 5 | 95 | acrylic resin | silicone resin | — | 0 | 0.15 | — | — | 0 | — |
| Com. Ex. 6 | 50 | acrylic resin | silicone resin | 1.0 | 80 | 0.15 | 6.7 | $Al_2O_3$ | 0 | — |

TABLE 4

| | physical properties of carrier at initial stage | | physical properties of carrier after 300,000 sheets run | |
|---|---|---|---|---|
| | tribo-charge amount (μc/g) | specific electric resistance Log (Ω · cm) | developing roller decreased amount of tribo-charge (μc/g) | decreased value in specific electric resistance Log (Ω · cm) |
| Ex. 9 | 25.4 | 12.6 | 4.7 | 1.9 |
| Ex. 10 | 22.7 | 11.8 | 3.4 | 1.1 |
| Ex. 11 | 23.1 | 14.3 | 2.7 | 1.0 |
| Ex. 12 | 17.1 | 11.7 | 1.8 | 0.8 |
| Ex. 13 | 16.8 | 11.2 | 1.9 | 0.9 |
| Ex. 14 | 18.3 | 12.6 | 1.2 | 0.8 |
| Ex. 15 | 18.8 | 12.3 | 2.1 | 0.8 |
| Com. Ex. 4 | 20.1 | 10.9 | exhausted lifetime at 130,000 sheets run (decreased in tribo-charge) | |
| Com. Ex. 5 | 21.6 | 12.4 | 5.4 | 2.3 |
| Com. Ex. 6 | 24.3 | 14.1 | 3.5 | 3.2 |

From both Tables 3 and 4, following regards are understood. Namely, Example 9, in which the inner layer being contacted with each carrier particle surface was an acrylic resin while the outer layer being overlaid on the inner layer was a silicone resin and amount of the acrylic resin was 85 wt. %, gave good performances that the decrease amount in electric charge of the carrier, the decrease value in resistance of the carrier were within objective values respectively, resulting excellent effects.

Example 10, in which the inner layer being contacted with each carrier particle surface was a silicone resin while the outer layer being overlaid on the inner layer was a an acrylic resin and amount of the acrylic resin was 50 wt. %, gave good performances that the decrease amount in electric charge of the carrier, the decrease value in resistance of the carrier were within objective values respectively, resulting excellent effects.

Example 11, in which the inner layer being contacted with each carrier particle surface was a acrylic resin while the outer layer being overlaid on the inner layer was a silicone resin, amount of the acrylic resin was 50 wt. %, and an amount of 80 wt. % of $Al_2O_3$ particles having a relative size FIG. represented by [D/h] of 0.3 were contained, gave good performances that the decrease amount in electric charge of the carrier, the decrease value in resistance of the carrier were within objective values respectively, resulting excellent effects.

Example 12, in which contained fine particles were $TiO_2$ instead of $Al_2O_3$ in Example 11, gave good performances that decrease amount in electric charge of the carrier, decrease value in resistance of the carrier, and change degree in scooped up amount of the developer onto developing roller were within objective values respectively, resulting excellent effects.

Example 13, in which contained fine particles were ZnO instead of $Al_2O_3$ in Example 11, gave good performances that decrease amount in electric charge of the carrier, decrease value in resistance of the carrier were within objective values respectively, resulting excellent effects.

Example 14, in which contained fine particles were carbon black particles dispersed in both coating resins instead of $Al_2O_3$ in Example 11, gave good performances that decrease amount in electric charge of the carrier, decrease value in resistance of the carrier were within objective values respectively, resulting excellent effects.

Example 15, in which contained fine particles were carbon black particles dispersed in merely acrylic resin in coating layer instead of $Al_2O_3$ in Example 11, gave good performances that decrease amount in electric charge of the carrier, decrease value in resistance of the carrier were within objective values respectively, resulting excellent effects On the other hand, Comparative Example 4, which was a similar Example as Example 10 excepting a point of employed acrylic resin in an amount of 5 wt. %, caused severe layer-scraping, therefore made significant image deterioration to a level of impossible practical use at 130000 paper sheets run, thus was not able to help stopping thereafter run.

Comparative Example 5, which was a similar Example as Example 10 excepting a point of employed acrylic resin in an amount of 95 wt. %, gave a severe decrease of tribo-charge and severe decrease of electric resistance, therefore made significant image deterioration to a level of impossible practical use.

Comparative Example 6, which was a similar Example as Example 11 excepting a point of employed fine particles having a relative size figure represented by [D/h] of 6.7, gave a severe decrease of tribo-charge and severe decrease of electric resistance, therefore made significant image deterioration to a level of impossible practical use.

Having now fully specified the invention, it will be apparent to one of skilled in the art that electrophotographic carrier of the present invention which having resinous surface-coating layer containing an acrylic resin and a silicone resin or containing a plural of layer consisting of an acrylic resin layer and a silicone resin layer, shows no accumulation of toner-spents, therefore can obtain a stable electric charge, and has no layer scraping in binder resin layer, therefore can obtain a stable electric resistance, hence occurs no deterioration of images reproduced.

Accordingly image deterioration which may occur through a long period of successive running by using the conventional carrier can improve significantly, and ranging a long period of time, good image reproducing action is maintained, with a scarce amount change of developer to be scraped up onto developing roller.

What is claimed is:

1. A carrier for electrophotographic developer comprising carrier particles, wherein each carrier particle has at least one surface-coating layer comprising a resin material, said surface-coating layer comprises an acrylic resin and a silicone resin, and said acrylic resin is in an amount ranging from 10 to 90 wt. % based on the total amount of resin coating ingredients, and wherein said surface coating layer comprises particles which have a particle-diameter (D) in the range of 1<[D/h]<5, where (h) is the thickness of said surface coating layer.

2. The carrier for electrophotographic developer according to claim 1, wherein said acrylic resin is a thermo-hardening acrylic resin.

3. The carrier for electrophotographic developer according to claim 1, wherein said silicone resin is a silicone resin having condensation reactive functional groups.

4. The carrier for electrophotographic developer according to claim 1, wherein said surface-coating layer comprises particles which have a particle-diameter (D) in the range of 1<[D/h]<5, where (h) is the thickness of said surface-coating layer, and said particles having been applied in an amount ranging 50 to 95 wt. % based on the total amount of coating composition ingredients.

5. The carrier for electrophotographic developer according to claim 1, wherein said carrier comprises particles which have a particle-diameter (D) in the range of 1<[D/h]<5, where (h) is the thickness of said surface-coating layer, and said particles are selected from the group consisting of aluminum oxide, titanium dioxide, zinc oxide, aluminum oxide modified by surface-treatment, titanium oxide modified by surface treatment, zinc oxide modified by surface treatment, or mixtures thereof.

6. The carrier for electrophotographic developer according to claim 1, wherein said surface-coating layer comprises carbon black material.

7. The carrier for electrophotographic developer according to claim 1, wherein said acrylic resin comprises carbon black material.

8. A carrier for electrophotographic developer comprising carrier particles, wherein each carrier particle has at least one surface-coating layer consisting of a plurality of resin material layers, wherein said resin material layers are selected from the group consisting of an acrylic resin layer and a silicone resin layer, and said acrylic resin is in an amount of 10 to 90 wt. % based on the total amount of resin coating ingredients.

9. The carrier for electrophotographic developer according to claim 8, wherein said acrylic resin layer is an inner layer being contacted with said carrier particle's surface, and said silicone resin layer is an outer layer being overlaid on said inner layer.

10. The carrier for electrophotographic developer according to claim 8, wherein the silicone resin layer is a layer of silicone resin having condensation reactive functional groups.

11. The carrier for electrophotographic developer according to claim 8, wherein the acrylic resin layer is thermo-hardening acrylic resin.

12. The carrier for electrophotographic developer according to claim 8, wherein the carrier containing particles have a particle-diameter (D) in the range of 1<[D/h]<5, in the relation of the (D) to the layer thickness (h) of the surface-coating layer.

13. The carrier for electrophotographic developer according to claim 8, wherein the carrier containing particles which have a particle-diameter (D) of the range 1<[D/h]<5, in the relation of the (D) to the layer thickness (h) of the surface-coating layer, the particles having been applied in an amount ranging from 50 to 95 wt % based on the total amount of coating composition ingredients.

14. The carrier for electrophotographic developer according to claim 8, wherein the carrier containing particles which have a particle-diameter (D) of the range 1<[D/h]<5, in the relation of the (D) to the layer thickness (h) of the surface-coating layer are selected from the group consisting of aluminum oxide, titanium dioxide, zinc oxide, aluminum oxide modified by surface-treatment, titanium oxide modified by surface treatment, zinc oxide modified by surface treatment, or mixtures thereof.

15. The carrier for electrophotographic developer according to claim 8, wherein the surface-coating layer contains carbon black material.

16. The carrier for electrophotographic developer according to claim 8, wherein the acrylic resin layer contains carbon black material.

17. An electrophotographic developer comprising at least one toner comprising toner particles and one carrier comprising carrier particles, wherein each toner particle comprises a binder resin and a coloring agent, and each carrier particle comprises at least one surface-coating layer comprising a resin material, wherein said surface-coating layer comprises an acrylic resin and a silicone resin, and said acrylic resin is in an amount of 10 to 90 wt. % based on the total amount of resin coating ingredients, and wherein said surface coating layer comprises particles which have a particle-diameter (D) in the range of 1<[D/h]<5, where (h) is the thickness of said surface coating layer.

18. An image forming apparatus using an electrophotographic developer, comprising at least one toner comprising toner particles and one carrier comprising carrier particles, wherein each toner particle comprises a binder resin and a coloring agent, and each carrier particle comprises at least one surface-coating layer comprising a resin material, wherein said surface-coating layer comprises an acrylic resin and a silicone resin, and said acrylic resin is in an amount of 10 to 90 wt. % based on the total amount of resin coating ingredients, and wherein said surface coating layer comprises particles which have a particle-diameter (D in the range of 1<[D/h]<5, where (h) is the thickness of said surface coating layer.

19. An image forming method using an electrophotographic developer, comprising at least one toner comprising toner particles and one carrier comprising carrier particles, wherein each toner particle comprises a binder resin and a coloring agent, and each carrier particle comprises at least one surface-coating layer comprising a resin material, wherein said surface-coating layer comprises an acrylic resin and a silicone resin, and said acrylic resin is in an amount of 10 to 90 wt. % based on the total amount of resin coating ingredients, and wherein said surface coating layer comprises particles which have a particle-diameter (D) in the range of 1<[D/h]<5, where (h) is the thickness of said surface coating layer.

* * * * *